US007621220B1

(12) United States Patent
Sanford et al.

(10) Patent No.: US 7,621,220 B1
(45) Date of Patent: Nov. 24, 2009

(54) WALL PENETRATING, AGENT DISPENSING WARHEAD

(76) Inventors: Matthew J. Sanford, 9035 Spicewood Run, Bel Alton, MD (US) 20611; Zachary A. Spears, 3459 Mackenzie Crossing, Cincinnati, OH (US) 45245; Pamela Johns, 207 Mercer Dr., Madison, AL (US) 35756

( * ) Notice: Subject to any disclaimer, the term of this patent is extended or adjusted under 35 U.S.C. 154(b) by 237 days.

(21) Appl. No.: 11/973,979

(22) Filed: Sep. 19, 2007

(51) Int. Cl.
*F42B 12/46* (2006.01)

(52) U.S. Cl. ..... 102/370; 102/367; 102/512; 102/513

(58) Field of Classification Search ..... 102/367, 102/370, 512, 513, 477
See application file for complete search history.

(56) References Cited

U.S. PATENT DOCUMENTS 2,273,166 A * 2/1942 Allen ..... 102/382
4,195,572 A 4/1980 Knapp
4,284,007 A * 8/1981 Arnell et al. ..... 102/477
4,667,601 A * 5/1987 Diamond et al. ..... 102/368
4,798,143 A * 1/1989 Graham ..... 102/370
6,053,109 A 4/2000 Rudenauer
6,209,461 B1 4/2001 Riffet et al.
6,250,226 B1 * 6/2001 Leichter et al. ..... 102/370
6,276,227 B1 8/2001 Schmacker
6,672,218 B2 1/2004 Oechslin et al.
7,461,701 B2 * 12/2008 Gross et al. ..... 169/30
2005/0229807 A1 10/2005 Brock et al.
2006/0249204 A1 * 11/2006 Bolt et al. ..... 137/68.14
2007/0235200 A1 * 10/2007 Gross ..... 169/30

* cited by examiner

*Primary Examiner*—Michael Carone
*Assistant Examiner*—Samir Abdosh
(74) *Attorney, Agent, or Firm*—Frederick J. Zimmerman

(57) ABSTRACT

A warhead includes a gas containing canister having a front end onto which is screwed a valve assembly having an interior which is in gas communication with the canister. A structure-penetrating nose connected onto the valve assembly. Positioned around a periphery of the valve assembly is a plurality of hollow frangible plugs. The nose includes a shoulder portion that shears the plugs upon impact with a target thus allowing gas within the canister and valve assembly to escape to an atmosphere.

13 Claims, 6 Drawing Sheets

WALL PENETRATING, AGENT DISPENSING WARHEAD

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1) Field of the Invention

The invention in general relates to warheads, and more particularly to a warhead used to disable hostiles located within a structure.

2) Description of the Related Art

In the field, when hostiles are in a building or other similar structure, there are several means of removing them. A common way is by means of teargas delivered via a gun. Tear gas canisters fired by a low power gun must be fired through a window. These devices are insufficient for firing through structures without windows. Another means of dealing with hostiles is via explosive warheads launched from a shoulder-fired weapon or mounted weapon system. This means however, is generally lethal to the hostiles and destructive to the building, which may be of historical or tactical value.

SUMMARY OF THE INVENTION

It is an object of the invention to provide a warhead that is a non-lethal and less destructive means of neutralizing hostiles.

It is another object to provide a warhead that can deliver a variety of dispersing agents.

A wall penetrating, agent dispersing warhead is provided, which includes a canister for containing a chemical dispersing agent and having a front end and a back end. A valve assembly is connected to the canister at the front end. The valve assembly has an open interior in gas communication with the contents of the canister. A plurality of frangible hollow shear plugs are threadedly connected to the valve assembly around the periphery thereof, selected ones of the plugs being in gas communication with the open interior of the valve assembly. A structure-penetrating nose is threadedly connected to the valve assembly. The nose has a shoulder portion proximate the plugs and operable to shear the plugs when the nose encounters a target. When the plugs are sheared, gas within the interior of the valve assembly is released to the atmosphere via the sheared plugs.

BRIEF DESCRIPTION OF THE DRAWINGS

In the drawings, which are not necessarily to scale, like or corresponding parts are denoted by like or corresponding reference numerals.

DETAILED DESCRIPTION OF EXEMPLARY EMBODIMENTS OF THE INVENTION

Figure 1:
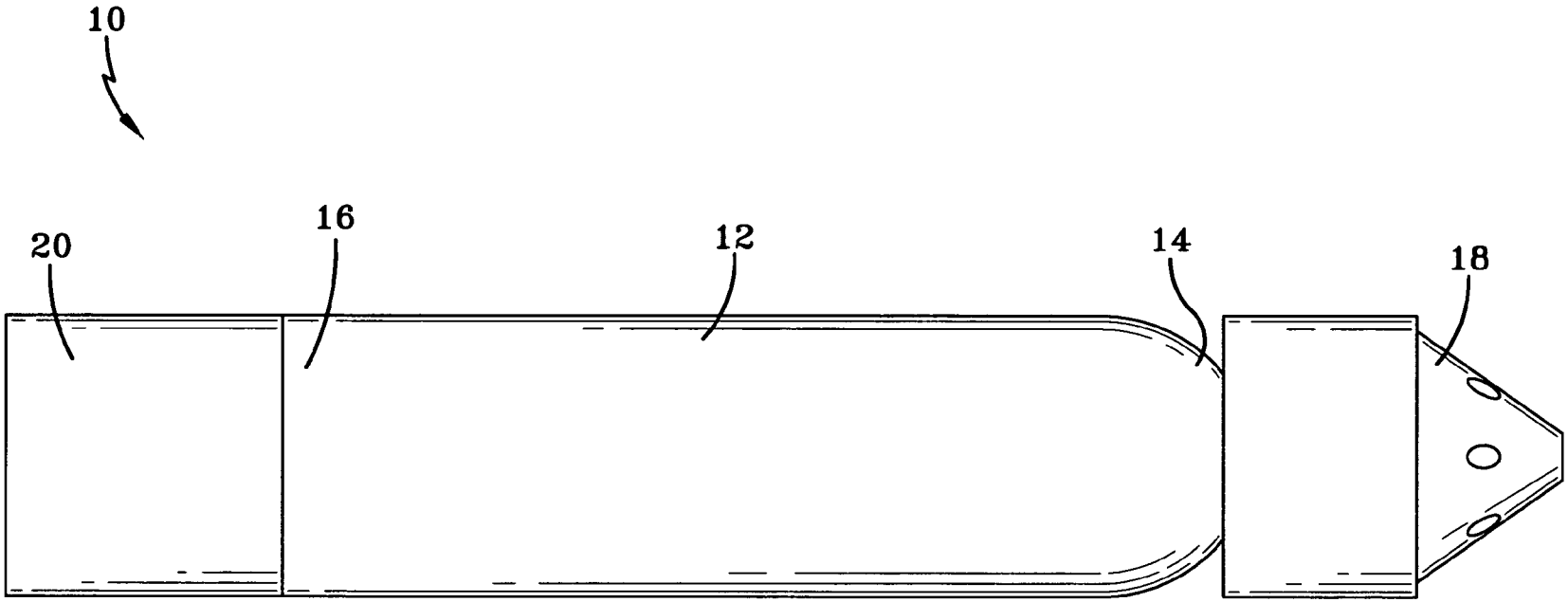
FIG. 1 is a side view of a warhead in accordance with an exemplary embodiment of the invention.

Referring now to FIG. 1, there is illustrated a warhead 10 including a canister 12 having a front end 14 and a back end 16. A structure-penetrating warhead nose 18 is connected at the front end 14 and a mass 20 is connected at the back end 16. The mass 20 is not a component of the invention but is added for test purposes to represent the flight weight of the expended rocket motor. The warhead 10 may be fired from a rocket launcher or an air gun and if the latter, the mass 20 is provided to simulate the mass of a rocket motor.

Figure 2:
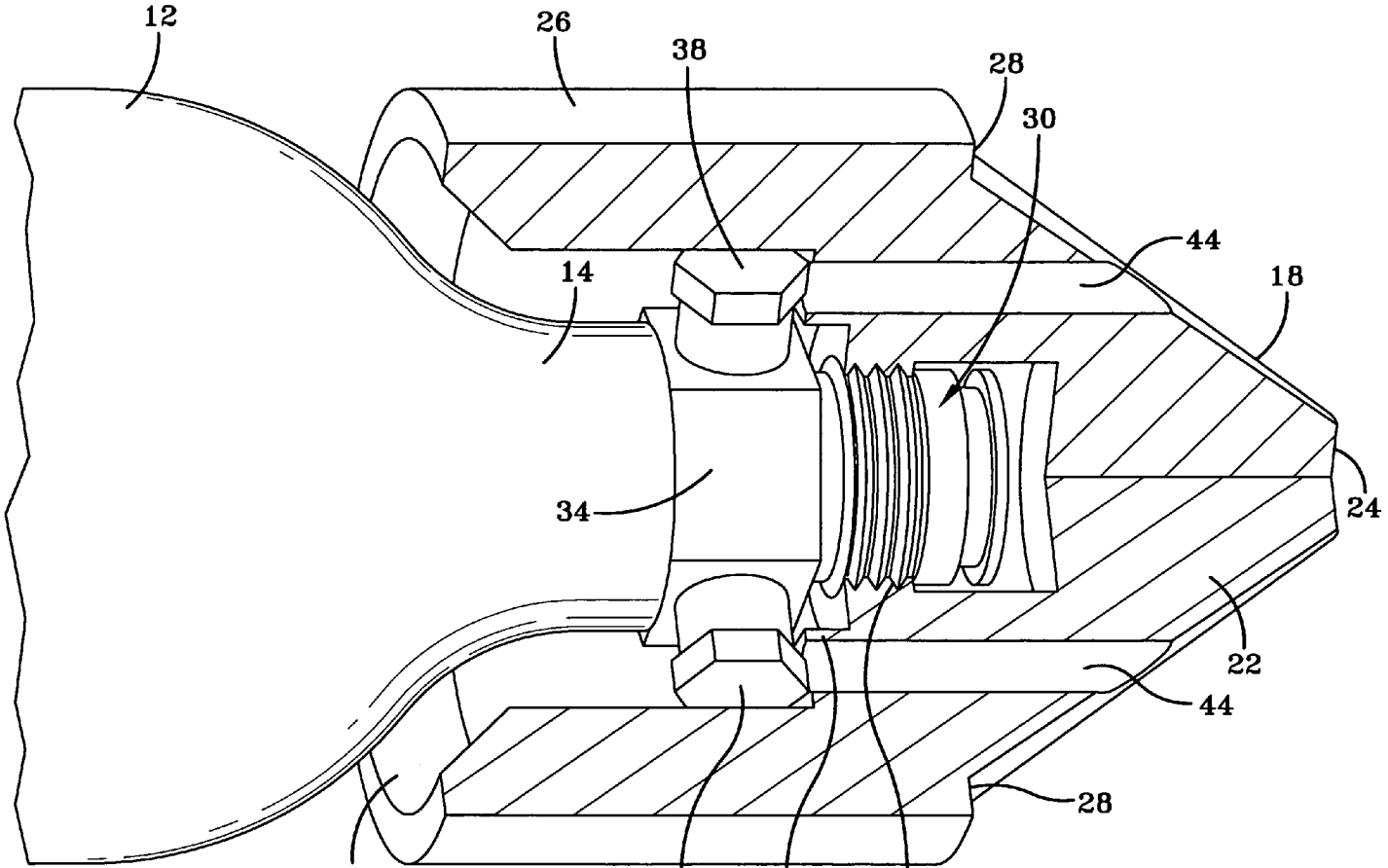
FIG. 2 is a view of the warhead of FIG. 1 with the nose cut away.

A cutaway of the nose 18 is illustrated in FIG. 2. Nose 18 includes a conical section 22 having a blunt tip 24. The conical section 22 joins with a cylindrical section 26 in a manner to define a lip or ridge 28. If the warhead hits a target at an angle, the ridge 28 will prevent the warhead 10 from deflecting off the target such that it generally continues in the approximate impact orientation as it passes through a wall.

FIG. 2 also illustrates a valve assembly 30 connected to the front end 14 of the canister 12. The valve assembly 30 includes frangible threads 32 to which the nose 18 is threaded. The valve assembly 30 has a faceted collar 34 around its periphery, which by way of example may include six faces. A plurality of frangible plugs are inserted through selected facets of the collar 34, and in an exemplary embodiment as illustrated, three plugs are used 120° apart. Two of the plugs, 36 and 38 may be seen.

When the warhead 10 strikes a target, frangible threads 32 may be sheared off and the nose 18 may move backwards toward the canister 12 such that a circumferential shoulder 40 in an interior of the nose 18 will shear frangible plugs 36 and 38, as well as the other plug, not seen. When selected ones of the plugs are broken, gas within canister 12 is allowed to escape to the atmosphere. The gas path may be through the opening 42 between the rear of the nose 18 and the front end 14 of the canister 12. In the event that this opening 42 may be blocked, there is provided an additional gas path in the form of gas channels 44 which extend from the interior of the nose 18 through the conical section 22 to the atmosphere.

Figure 3:
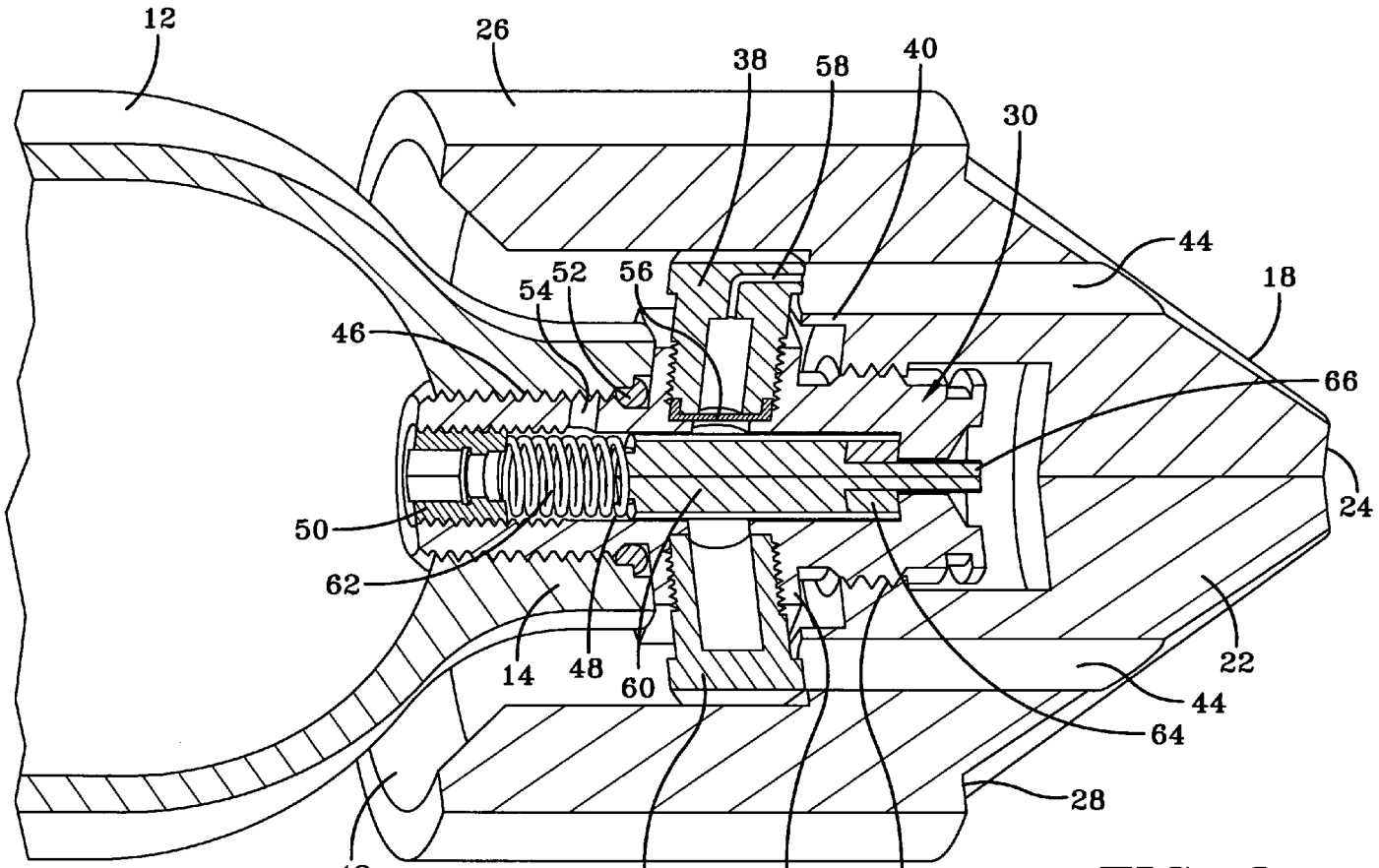
FIG. 3 is a view of the warhead of FIG. 2 with the nose and a valve assembly cut away.

A more detailed view of the valve assembly 30 may be seen in FIG. 3. The valve assembly 30 includes threads 46 that screw into the end of canister 12. The valve assembly 30 has an interior 48 that is in gas communication with the gaseous interior of the canister 12. This gas communication is via a hollow setscrew 50 at the left end of valve assembly 30, which is substantially adjacent the front end of the canister 12. An O-ring or other type of seal 52 is positioned between the end of canister 12 and collar 34.

In the event that the valve assembly 30 is unscrewed while the canister 12 is still charged, there is a possibility of a dangerous explosive detachment of the valve assembly 30 from the canister 12. To prevent this event, threads 46 include an aperture 54 that extends from the outside of valve assembly 30 to its interior 48. If the valve assembly 30 is prematurely unscrewed, the pressure will be gently relieved once the aperture 54 is past the end of canister 12, preventing explosive detachment.

Another safety feature of the invention is the inclusion of a rupture disk 56 located at the base of plug 38. If the gas pressure within canister 12 becomes overpressurized, rupture disk 56 may rupture allowing gas to escape through gas channel 58 in the head of plug 38 and out a channel 44.

Canister 12 may be filled with, in an exemplary embodiment, a dispersing agent, such as, tear gas or a combination of a liquid with a charging gas such as carbon dioxide. Exemplary liquids include malodorous liquids, for example synthetic skunk oil, or a marking agent. A gas may be introduced into canister 12 by means of the valve assembly 30. More particularly, the valve assembly 30 includes a valve stem 60 that at one end bears against a spring 62. The other end of valve stem 60 normally bears against a seal 64 and includes a rod 66 that extends out of the valve assembly 30.

When the canister 12 is to be filled with a gas, and prior to the nose 18 being attached, a gas fixture (not illustrated) is screwed onto threads 32. The gas fixture depresses rod 66 such that valve stem 60 is disengaged from seal 64, thus allowing charging gas to enter valve assembly 30 and canister 12. Thereafter, the gas fixture is removed and the nose 18 applied.

In use, the warhead is fired at a target and when it hits the target, the force of impact causes threads 32 to shear off. The nose 18 is forced backwards relative to the canister such that shoulder 40 ruptures all of the three frangible plugs. Taking plug 36 as representative, when it ruptures, gas within the valve assembly 30 exits to the atmosphere via the interior of the plug and through its ruptured portion, by way of opening 42 and/or channels 44. Since plug 38 includes the unbroken rupture disk 56 no gas escapes through that plug even though it is ruptured.

Nose 18, in an exemplary embodiment, may be made of aluminum, for example, 2024 aluminum, 7075 aluminum, 2024 aluminum heat treated with Teflon impregnate, or 7075 aluminum nickel plated with Teflon impregnate. Nose 18 has a cylindrical section 26 that has a diameter large enough to cover the frangible plugs. Another example of a nose material is heat-treated 1060 steel, one example of which is illustrated in FIG. 4.

Figure 4:
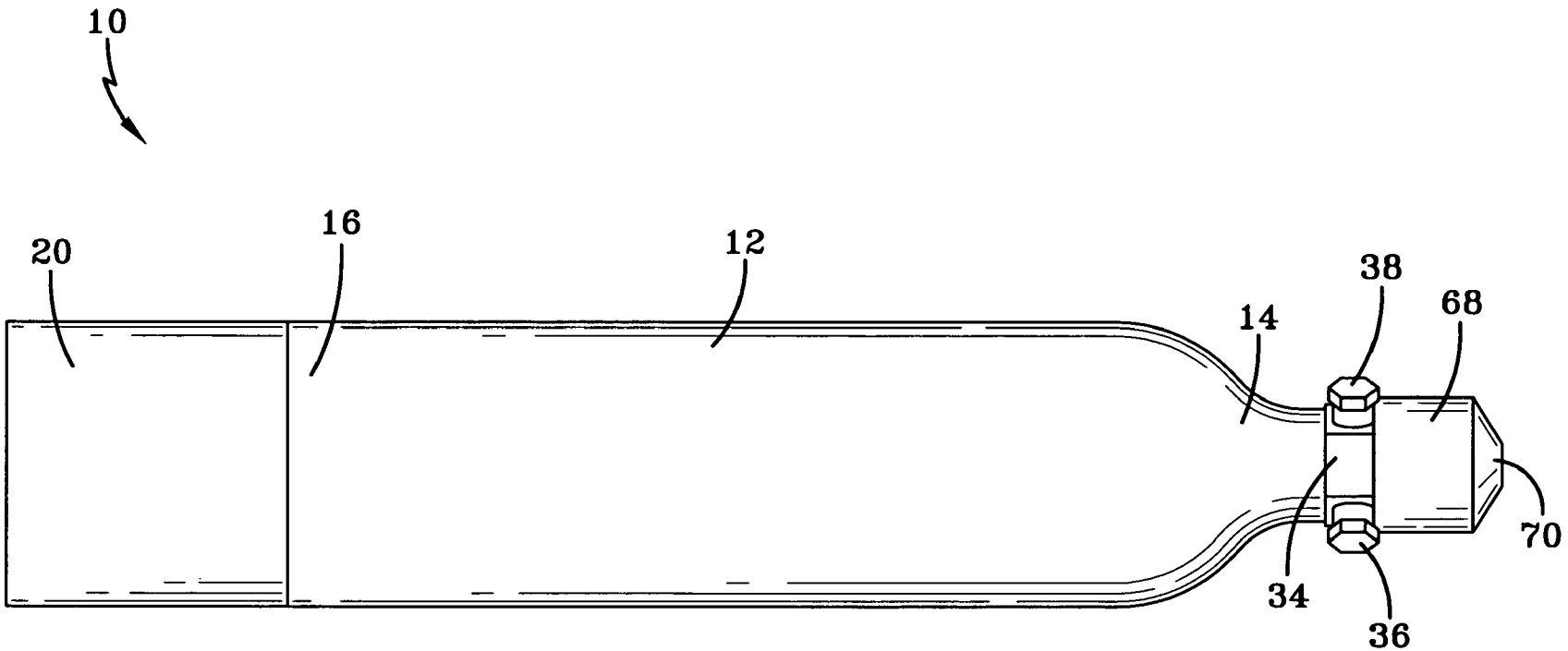
FIG. 4 is a side view of a warhead in accordance with another embodiment of the invention.
Figure 5:
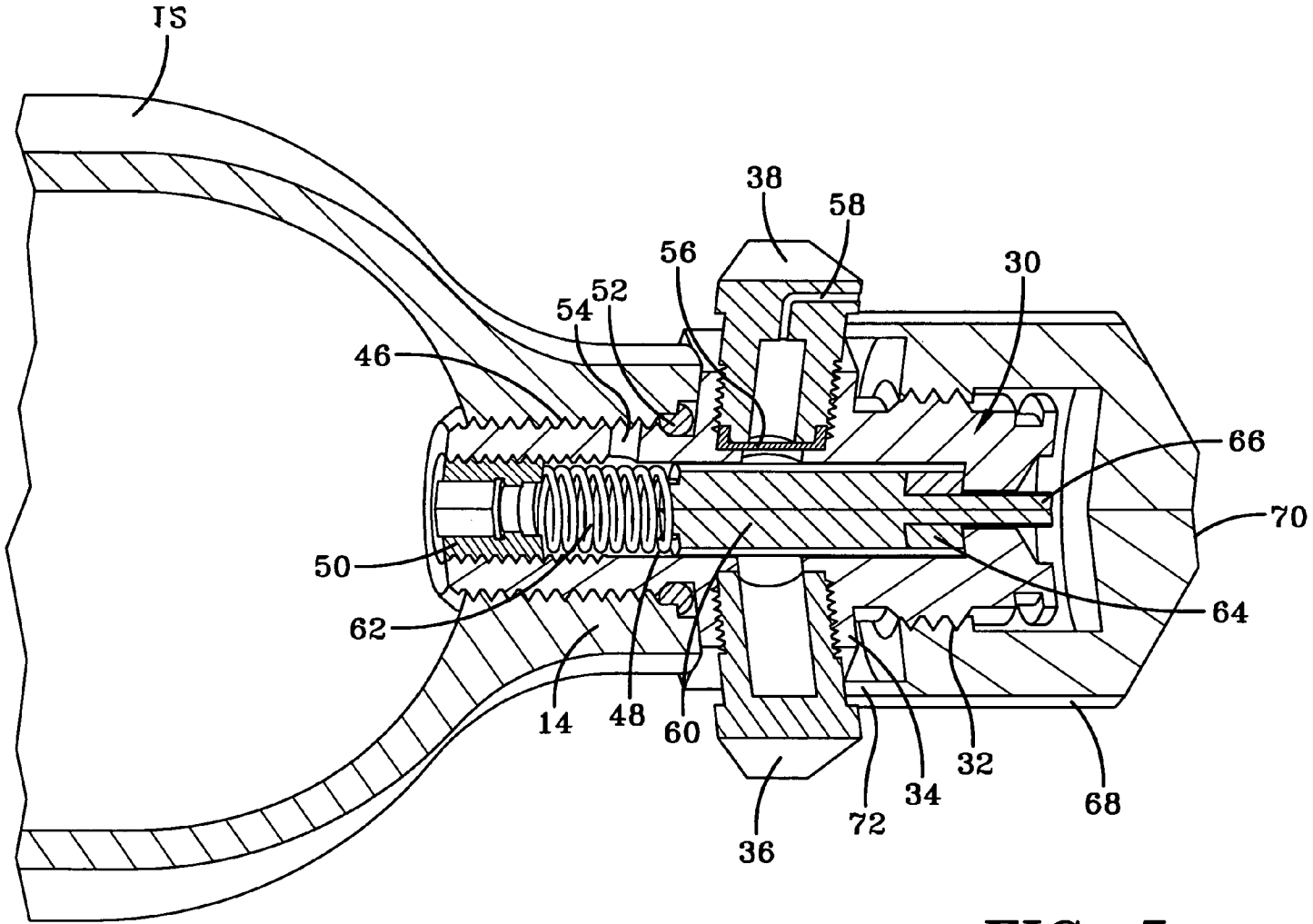
FIG. 5 is a view of the warhead of FIG. 4 with the nose and valve assembly cut away.

The warhead 12 of FIG. 4 is identical to that previously described except that it has a nose 68 of smaller diameter with a larger blunted tip 70. A cut away view is illustrated in FIG. 5. Due to the smaller diameter of the nose 68, all of the plugs, including plugs 36 and 38, are exposed. The outer cylindrical surface of nose 68 terminates in a shoulder 72 that is positioned and operative to rupture the plugs on impact with a target. When the plugs are ruptured, gas within valve assembly 30 is conducted directly to the atmosphere.

Figure 6:
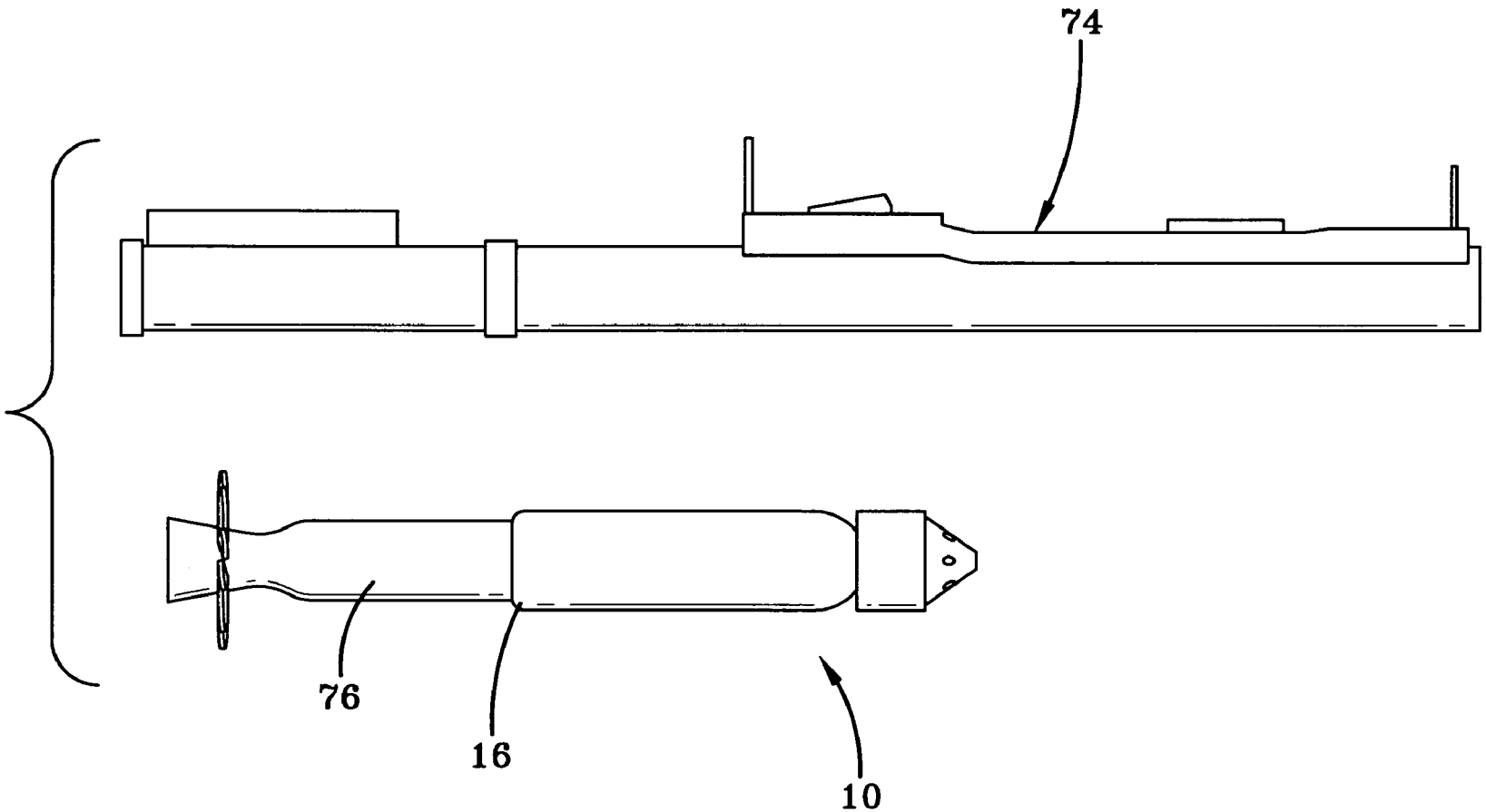
FIG. 6 illustrates a delivery system for the warhead.

FIG. 6 illustrates a means for delivering the warhead 10 to a target. A standard M72 launcher 74 launches warhead 10 having a rocket motor 76 attached at its back end 16. The warhead 10 is placed in the launcher 74 and is fired at the intended target to thereby disperse its gas into the building or other structure in a non-lethal manner, thus providing the operator with a safe means of forced removal of hostiles.

It will be understood that many additional changes in the details, materials, steps and arrangement of parts, which have been herein described and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A wall penetrating, agent dispersing warhead, comprising:

a canister for containing a chemical dispersing agent and having a front end and a back end;

a valve assembly connected to said canister at said front end, said valve assembly having an open interior in gas communication with the contents of said canister;

a plurality of frangible, hollow shear plugs threadedly connected to said valve assembly around the periphery thereof, selected ones of said plurality of frangible, hollow plugs being in gas communication with said open interior of said valve assembly; and a structure-penetrating nose threadedly connected to said valve assembly by frangible threads, said structure-penetrating nose having a shoulder portion proximate said plugs and operable to shear said plurality of frangible, hollow shear plugs when said nose encounters a target, wherein gas within said open interior of said valve assembly is released to an atmosphere via said plurality of frangible, hollow shear plugs when sheared.

2. The warhead according to claim 1, wherein each of said plurality of frangible, hollow shear plugs comprises a head portion and a base, wherein at least one of said plurality of frangible, hollow shear plugs includes a gas channel, which extends from an interior portion of said at least one of said plurality of frangible, hollow shear plugs through said head portion to an atmosphere, and wherein said at least one of said plurality of frangible, hollow shear plugs includes a rupture disk at a base thereof to allow gas in said canister to escape to the atmosphere upon overpressurization of said canister.

3. The warhead according to claim 1, wherein said structure-penetrating nose includes a cylindrical section joined with a conical section having a blunted tip, and wherein a diameter of said cylindrical section covers said plurality of frangible, hollow shear plugs when said structure-penetrating nose is connected to said valve assembly.

4. The warhead according to claim 3, wherein said structure-penetrating nose is comprised of an aluminum material.

5. The warhead according to claim 1, wherein said structure-penetrating nose includes a cylindrical section joined with the conical section including a blunted tip, and wherein the diameter is such that said plurality of frangible, hollow shear plugs are exposed when said structure-penetrating nose is connected to said valve assembly.

6. The warhead according to claim 1, wherein said structure-penetrating nose is comprised of a steel material.

7. The warhead according to claim 1, wherein said valve assembly includes a faceted collar situated around a periphery of said valve assembly, and wherein said plurality of frangible, hollow shear plugs are inserted through selected facets of said faceted collar.

8. The warhead according to claim 7, wherein said collar includes six facets and three of said plurality of frangible, hollow shear plugs, and wherein said plurality of frangible, hollow shear plugs are arranged on said faceted collar.

9. The warhead according to claim 1, wherein said valve assembly is threadedly connected to said canister, and wherein said valve assembly includes an aperture through a threaded connection of said valve assembly with said canister to allow release of gas pressure when said valve assembly is partially unscrewed.

10. The warhead according to claim 1, wherein said warhead is shot from an air gun, and wherein said warhead includes a mass connected to said back end of said canister to simulate the weight of a rocket motor.

11. The warhead according to claim 1, wherein said structure-penetrating nose includes a plurality of gas channels extending therethrough to allow escape of gas to an atmosphere when said plurality of frangible, hollow shear plugs are sheared.

12. The warhead according to claim 1, wherein said open interior of said valve assembly includes a valve stem abutting a spring at one end thereof, and wherein said valve stem normally abuts a seal at an opposite end thereof.

13. The warhead according to claim 12, wherein said valve stem includes a rod at said opposite end, wherein said rod extends through said seal and out of an end of said valve assembly, and wherein said rod moves against action of said spring thereby moves said valve stem out of engagement with said seal thus permits introduction of gas to fill said canister.

* * * * *